US007081702B2

(12) United States Patent
Seo

(10) Patent No.: US 7,081,702 B2
(45) Date of Patent: Jul. 25, 2006

(54) ELECTRODELESS LIGHTING SYSTEM

(75) Inventor: Seong-Tae Seo, Daegu (KR)

(73) Assignee: LG Electronics Inc. (KR)

( * ) Notice: Subject to any disclaimer, the term of this patent is extended or adjusted under 35 U.S.C. 154(b) by 365 days.

(21) Appl. No.: 10/754,838

(22) Filed: Jan. 8, 2004

(65) Prior Publication Data

US 2005/0047139 A1 Mar. 3, 2005

(30) Foreign Application Priority Data

Sep. 3, 2003 (KR) ..... 10-2003-0061442

(51) Int. Cl.
*H01J 1/62* (2006.01)
*H01J 63/04* (2006.01)

(52) U.S. Cl. ..... 313/153; 313/160; 315/248; 315/344

(58) Field of Classification Search ..... None
See application file for complete search history.

(56) References Cited

U.S. PATENT DOCUMENTS 6,734,628 B1 5/2004 Seki et al. ..... 313/623
2003/0132719 A1* 7/2003 Choi et al. ..... 315/248
2004/0080258 A1* 4/2004 Choi et al. ..... 313/493

OTHER PUBLICATIONS

Indian Search Report dated Nov. 24, 2004.

* cited by examiner

*Primary Examiner*—Ashok Patel
(74) *Attorney, Agent, or Firm*—Ostrolenk, Faber, Gerb & Soffen, LLP

(57) ABSTRACT

An electrodeless lighting system includes: a resonator installed at an outlet of a waveguide guiding microwave energy generated from a magnetron and defining a cavity allowing light to pass therethrough while resonating microwave therein; a bulb positioned in the resonator and enclosing a radiation material for emitting light by the microwave energy; and one or plural microwave concentrating units installed at the inner circumferential surface of the resonator and concentrating microwave energy discharged from the outlet of the waveguide to the bulb. By concentrating microwave to electrodeless plasma bulb positioned inside the resonator, a stability in an initial lighting and light efficiency can be enhanced.

7 Claims, 5 Drawing Sheets

ELECTRODELESS LIGHTING SYSTEM

BACKGROUND OF THE INVENTION

1. Field of the Invention

The present invention relates to an electrodeless lighting system and, more particularly, to an electrodeless lighting system capable of heightening a light efficiency by concentrating microwave to an electrodeless plasma bulb positioned inside a resonator.

2. Description of the Background Art

In general, a light system using microwave is a device radiating visible ray or ultraviolet ray by applying a microwave energy to an electrodeless plasma bulb, of which a lamp has a long life span compared to a general incandescent electric lamp or a fluorescent lamp and excellent illumination effect.

FIG. 1 is a vertical-sectional view showing a lighting system using microwave energy in accordance with a conventional art.

As shown in FIG. 1, the conventional lighting system using microwave energy includes: a case 1 forming a predetermined internal space; a magnetron 2 mounted inside the case 1 and generating microwave; a high voltage generator 3 increasing general AC power to a high voltage and supplying it to the magnetron 2; a waveguide 4 for guiding microwave generated from the magnetron 2; a resonator 6 installed at an outlet of the waveguide 4, communicating with the waveguide 4, and preventing leakage of microwave while allowing light to pass therethrough; and a bulb 5 positioned inside the resonator 6 and generating light as an enclosed material becomes plasma by a microwave energy transmitted through the waveguide 4.

The lighting system using microwave also includes a reflection mirror 7 formed at a front side of the case land a neighboring region of the resonator 6, to concentratively reflect light generated from the bulb 5 forwardly.

A dielectric mirror 8 is installed in the outlet 4*a* of the waveguide 4 to allow microwave transmitted through the waveguide to pass therethrough and light emitted from the bulb 5 to be reflected forwardly, and a hole 8*a* is formed at the center of the dielectric mirror 8 to allow an shaft part 9 of the bulb 5 to penetrate therethrough.

A cooling fan assembly 10 for cooling the magnetron 2 and the high voltage generator 3 is provided at a rear side of the case 1.

Reference numeral 10*a* denotes a fan housing, 10*b* denotes a blowing fan, M1 denotes a bulb motor, and M2 denotes a fan motor.

The conventional lighting system using microwave is operated as follows.

When a drive signal is inputted to the high voltage generator 3, the high voltage generator 3 increases AC power and supplies the increased high voltage to the magnetron 2. Then, oscillated by the high voltage, the magnetron 2 generates microwave having a very high frequency. The thusly generated microwave is guided through the waveguide 4 and radiated into the resonator 6 through a slot part 4*b* formed at the inner side of the outlet 4*a* of the waveguide. 4 discharges a material enclosed in the bulb 5 to generate light having a specific spectrum, and as light is reflected forwardly by the reflection mirror 7 and the dielectric mirror 8, the illuminated space becomes bright.

However, the conventional electrodeless lighting system has the following problem.

That is, since microwave introduced into the resonator through the waveguide is not concentrated around the bulb but spread out, failing to form a strong electric field. This makes the bulb unstable in its initial lighting and a radiation efficiency of the bulb is degraded.

SUMMARY OF THE INVENTION

Therefore, an object of the present invention is to provide an electrodeless lighting system capable of enhancing a radiation efficiency by concentrating microwave to an electrodeless plasma bulb positioned inside a resonator.

To achieve these and other advantages and in accordance with the purpose of the present invention, as embodied and broadly described herein, there is provided an electrodeless lighting system including: a resonator installed at an outlet of a waveguide guiding microwave energy generated from a magnetron and defining a cavity allowing light to pass therethrough while resonating microwave therein; a bulb positioned in the resonator and enclosing a radiation material for emitting light by the microwave energy; and one or plural microwave concentrating units installed at the inner circumferential surface of the resonator and concentrating microwave energy discharged from the outlet of the waveguide to the bulb.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There can be several embodiments of an electrodeless lighting system in accordance with the present invention, of which the most preferred one will now be described.

The coverage of the present invention is not limited to the below-described specific embodiment but can be modified within the scope recited in claims.

Figure 1:
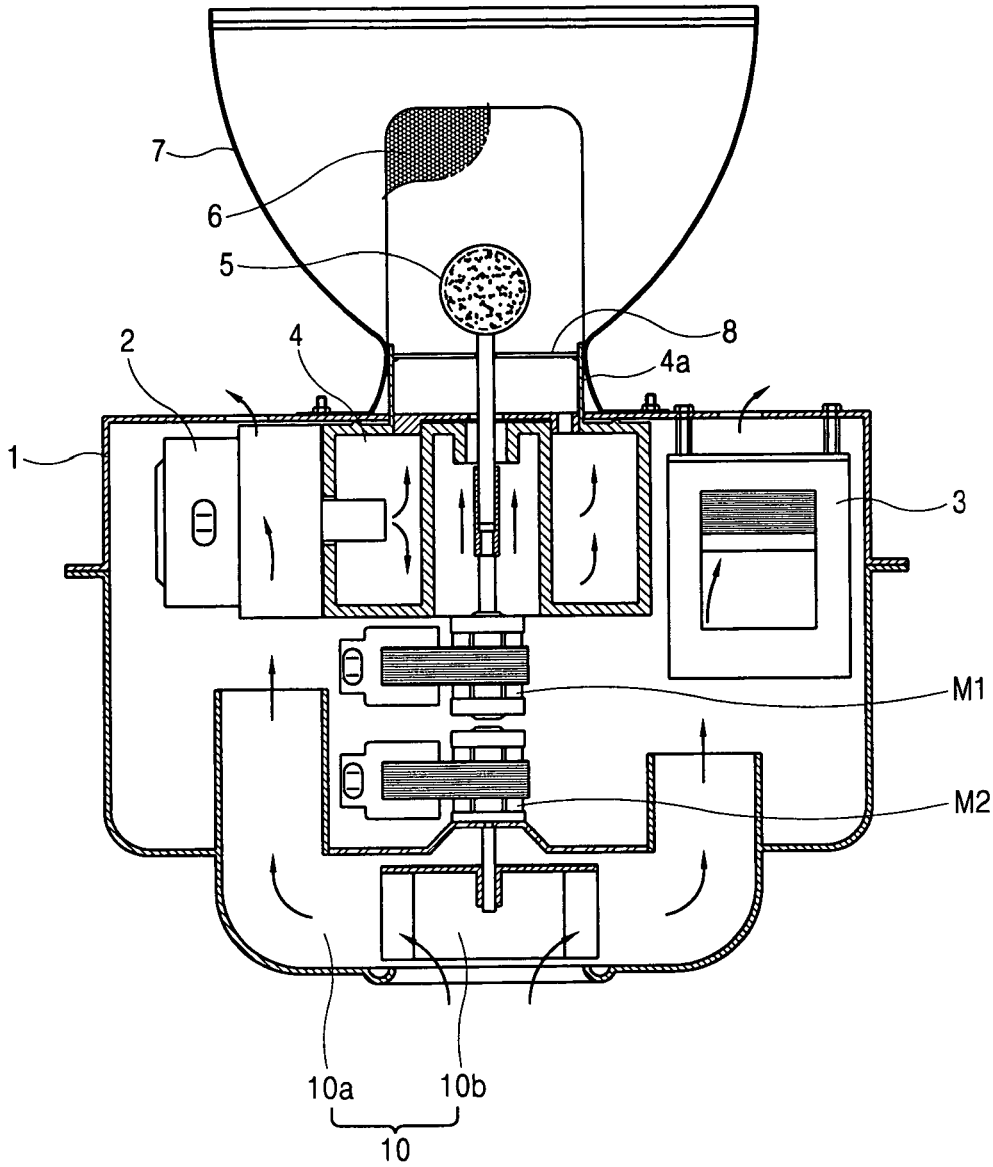
FIG. 1 CONVENTIONAL ART
FIG. 1 is a sectional view showing an internal structure of an electrodeless lighting system in accordance with a conventional art.
Figure 2:
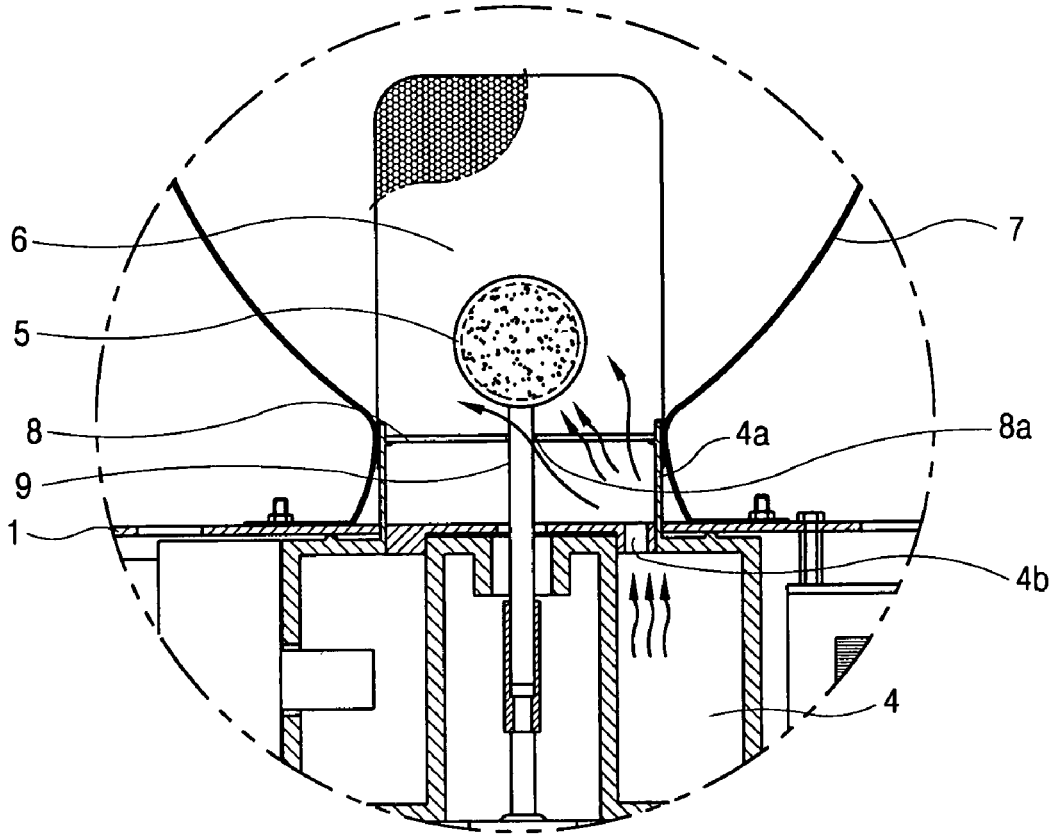
FIG. 2 CONVENTIONAL ART
FIG. 2 is a partial sectional view showing the interior of a resonator of the electrodeless lighting system in accordance with the conventional art.
Figure 3:
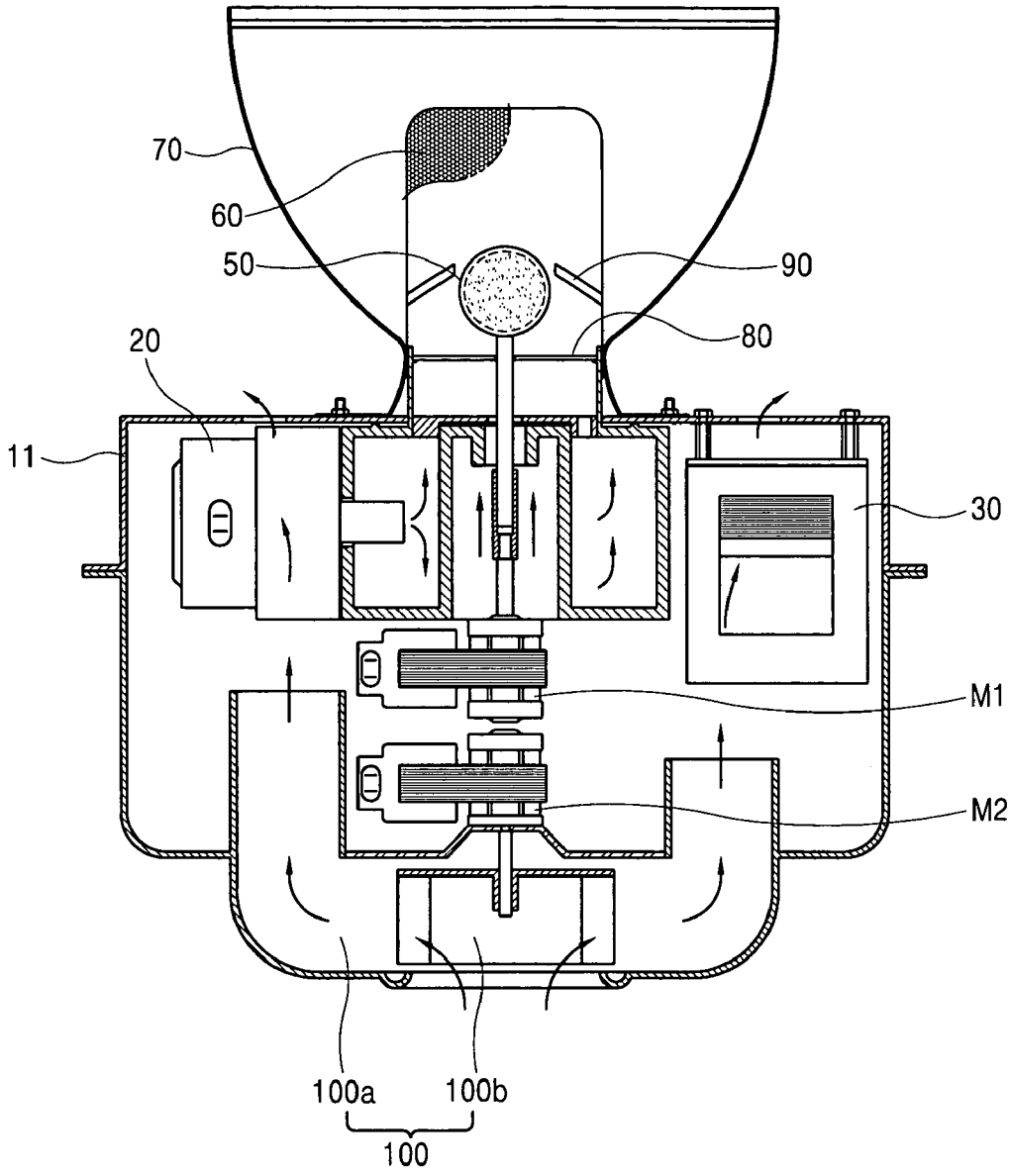
FIG. 3 is a sectional view showing an internal structure of an electrodeless lighting system in accordance with the present invention.
Figure 4:
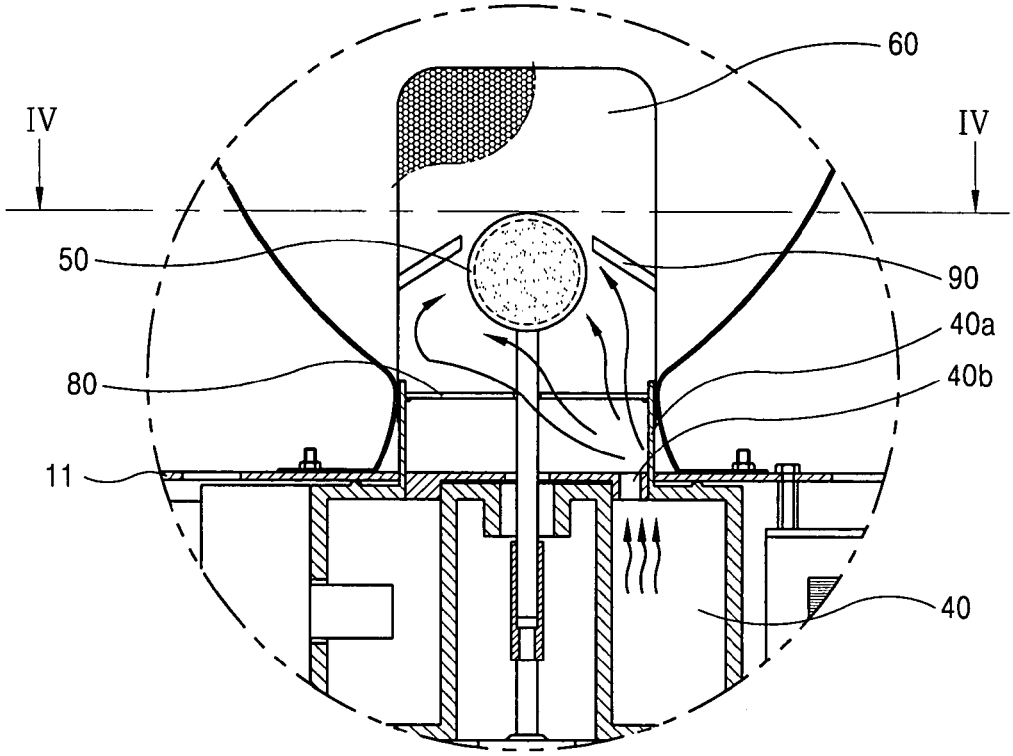
FIG. 4 is a partial sectional view showing the interior of a resonator of the electrodeless lighting system in accordance with the present invention.
Figure 5:
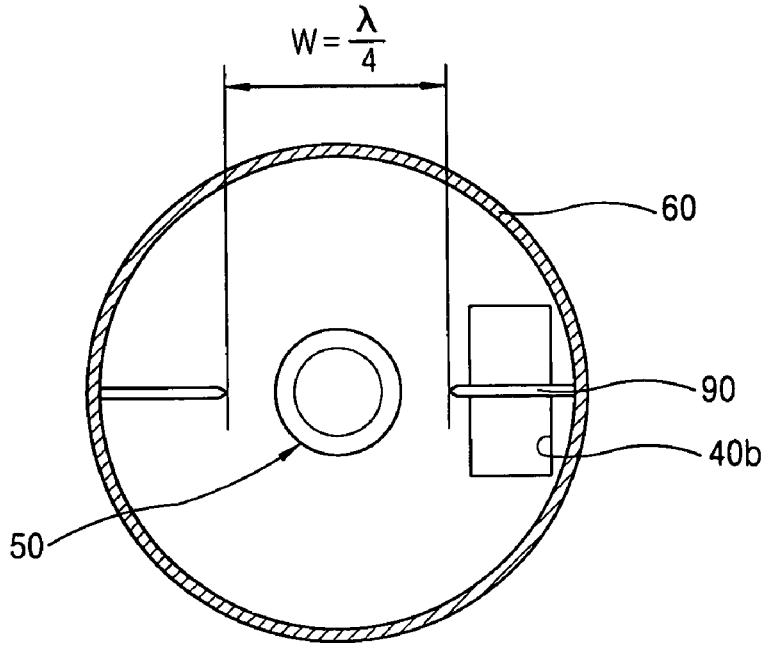
FIG. 5 is a plane view of one embodiment of a microwave concentrating unit mounted at the resonator through a section taken along line IV—IV of FIG. 4.
Figure 6:
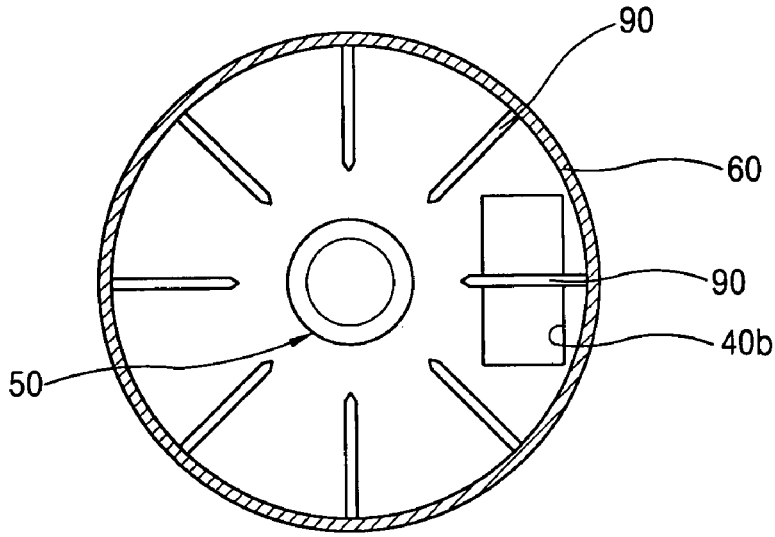
FIG. 6 is a plane view showing another embodiment of the microwave concentrating unit mounted at the resonator through a section taken along line IV—IV of FIG. 4.

FIG. 3 is a sectional view showing an internal structure of an electrodeless lighting system in accordance with the present invention, FIG. 4 is a partial sectional view showing the interior of a resonator of the electrodeless lighting system in accordance with the present invention, FIG. 5 is a plane view of one embodiment of a microwave concentrating unit mounted at the resonator through a section taken along line IV—IV of FIG. 4, and FIG. 6 is a plane view showing another embodiment of the microwave concentrating unit mounted at the resonator through a section taken along line IV—IV of FIG. 4.

As illustrated in FIGS. 3 to 5, the electrodeless lighting system of the present invention includes: a case 11 forming a predetermined internal space; a magnetron 20 mounted inside the case 11 and generating microwave; a high voltage generator 30 for increasing general AC power to a high voltage and supplying it to the magnetron 20; a waveguide 40 for guiding microwave generated from the magnetron 20; a resonator 60 installed at an outlet 40*a* of the waveguide 40, preventing leakage of microwave and allowing light to pass therethrough, and resonating microwave therein; a bulb 50 positioned in the resonator 60 and enclosing a radiation material for emitting light by the microwave energy transmitted through the outlet of the waveguide 40; a reflection mirror 80 for concentratively reflecting light generated from the bulb 50 forwardly at a front side of the case 11 and a neighboring region of the resonator 6; and a dielectric mirror 8 positioned in the outlet 4*a* of the waveguide 40, allowing microwave guided through the waveguide 4 to pass therethrough and reflecting light radiated from the bulb 50 forwardly.

A slot 40*b* is formed at an inner side of the outlet 40*a* of the waveguide 40, so as for microwave to be transferred to the resonator 60.

A cooling fan assembly 100 is provided at a rear side of the case 11 to cool the magnetron 20 and high voltage generator 30.

Reference numeral 100*a* denotes a fan housing, 100*b* denotes a blowing fan, M1 denotes a bulb motor, and M2 denotes a fan motor.

At least one or more microwave concentrating unit 90 is/are mounted at an inner circumferential surface of the resonator 60 to concentrate microwave energy discharged from the slot 40*b* of the waveguide 40 to the bulb.

It is preferred that the microwave concentrating unit 90 is formed in a pin shape so that one end thereof is coupled to the inner circumferential surface of the resonator 60 and the other end faces the bulb 50.

The microwave concentrating unit 90 is formed inclined more upwardly as it approaches the bulb 50 from the inner circumferential surface of the resonator 60, and is installed at the inner circumferential surface of the resonator 60 to approach the bulb 50 within a diameter range of the bulb 50 so that it can most effectively concentrate microwave introduced into the resonator 60 through the waveguide 40.

In addition, in order to transfer microwave more quickly and effectively, preferably, at least one of the microwave concentrating units 90 is positioned at the center of the slot 50*b* formed at the waveguide 40.

If two or more microwave concentrating units 90 are mounted, it is preferred that they are mounted at regular intervals in a circumferential direction at the inner circumferential surface of the resonator symmetrically with the bulb therebetween, and in this case, the interval between both ends of the microwave concentrating units 90 which are close to the bulb 50 and symmetrically face each other is greater than ¼ of the wavelength of the microwave.

The electrodeless lighting system constructed as described above is operated as follows.

When a drive signal is inputted to the high voltage generator 30, the high voltage generator 30 increases AC power to supply an increased high voltage to the magnetron 20. Then, as the magnetron 20 is oscillated by the high voltage, microwave having a very high frequency is generated. The thusly generated microwave is guided through the waveguide 40 and radiated into the resonator 60 through the slot 40*b* formed at the inner side of the outlet 40*a* of the waveguide 40.

The thusly radiated microwave spreads uniformly inside the resonator 60 and is simultaneously concentrated around the bulb 50 along the pin-shaped microwave concentrating unit 90. Thanks to the thusly concentrated microwave, a strong electric field is quickly distributed around the bulb 50, the radiation material enclosed in the bulb 50 is discharged and at the same time excited by the strong electric field, generating plasma. Consequently, as light emitted during generation of plasma from the bulb 50 is reflected to the dielectric mirror 80 and the reflection mirror 70, it illuminates forwardly.

As so far described, the electrodeless lighting system of the present invention has such an advantage that because microwave is concentrated around the bulb by the pin-shaped microwave concentrating units mounted inside the resonator and accordingly a strong electric field is quickly distributed around the bulb to allow the bulb to emit light, a stability in the initial lighting of the electrodeless lighting system is enhanced and a light efficiency is improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electrodeless lighting system comprising:

a resonator installed at an outlet of a waveguide guiding microwave energy generated from a magnetron and defining a cavity allowing light to pass therethrough while resonating microwave therein;

a bulb positioned in the resonator and enclosing a radiation material for emitting light by the microwave energy; and one or plural microwave concentrating units installed at the inner circumferential surface of the resonator and concentrating microwave energy discharged from the outlet of the waveguide to the bulb.

2. The system of claim 1, wherein the microwave concentrating unit has a pin shape.

3. The system of claim 1, wherein the microwave concentrating unit is formed inclined upwardly as it approaches the bulb from the inner circumferential surface of the resonator.

4. The system of claim 1, wherein the microwave concentrating unit is formed near the bulb within a diameter range of the bulb.

5. The system of claim 1, wherein at least one of the microwave concentrating units installed at the inner circumferential surface of the resonator is positioned at the center of a slot formed at the waveguide.

6. The system of claim 1, wherein the microwave concentrating units are mounted at regular intervals in a circumferential direction at the inner circumferential surface of the resonator symmetrically with the bulb therebetween.

7. The system of claim 6, wherein the interval between both ends of the microwave concentrating units which are close to the bulb 50 and symmetrically face each other is greater than ¼ of the wavelength of the microwave.

* * * * *